United States Patent [19]

Piazzalunga

[11] 4,078,345

[45] Mar. 14, 1978

[54] PREFABRICATED BUILDING AND METHOD OF MAKING SAME

[76] Inventor: Pietro Piazzalunga, Largo Carsia dei Servi 3, Milan, Italy

[21] Appl. No.: 720,043

[22] Filed: Aug. 30, 1976

Related U.S. Application Data

[63] Continuation-in-part of Ser. No. 361,038, May 17, 1973, abandoned.

[30] Foreign Application Priority Data

Dec. 29, 1972 Italy .....33896 A/72
May 20, 1976 Italy .....23464/A76

[51] Int. Cl.[2] ..... E04B 1/348; E04G 21/00; E04H 1/04

[52] U.S. Cl. ..... 52/79.13; 52/79.14; 52/236.9; 52/745

[58] Field of Search ..... 52/295, 293, 79, 294, 52/79.13, 79.4, 236.9, 745, 283

[56] References Cited

U.S. PATENT DOCUMENTS

| | | | |
|---|---|---|---|
| 1,362,069 | 12/1920 | Witzel | 52/79 |
| 2,240,427 | 4/1941 | Thomsen | 52/295 |
| 3,812,637 | 5/1974 | Yang | 52/79 |
| 3,818,660 | 6/1974 | Dillon | 52/79 |
| 3,855,743 | 12/1974 | Wokas | 52/79 |
| 3,894,373 | 7/1975 | Willingham | 52/79 |

FOREIGN PATENT DOCUMENTS

| | | | |
|---|---|---|---|
| 2,041,762 | 6/1972 | Germany | 52/79.14 |
| 1,011,916 | 12/1965 | United Kingdom | 52/79.12 |

*Primary Examiner*—John E. Murtagh
*Attorney, Agent, or Firm*—Michael J. Striker

[57] ABSTRACT

A multistory building is constructed by positioning in spaced-apart relationship on a concrete base a plurality of box-like room units each having parallel ceiling and floor panels joined by a continuous perimetric side wall. The room units are bolted to the base and partition panels are positioned in upright position between the room units to subdivide the regions between these room units into horizontally separated room spaces. Floor panels are then bridged between the room units over at least some of the room spaces and the floor panels and partition panels are all bolted in place onto the room units and each other. Thereafter second-floor room units are bolted on top of the first-floor room units along with further partition and floor panels so as to form a second floor and the building is constructed upwardly for as many floors as desired in this manner.

15 Claims, 15 Drawing Figures

PREFABRICATED BUILDING AND METHOD OF MAKING SAME

CROSS-REFERENCE TO RELATED APPLICATION

This application is a continuation-in-part of my copending patent application Ser. No. 361,038 filed May 17, 1973 and now abandoned.

FIELD OF THE INVENTION

My present invention relates to a multistory building and method of making same. More particularly this invention concerns a prefabricated building structure and method of assembling same.

The standard method of making a multistory building is to pour a foundation, then build a frame, then finish off the frame by providing partition walls as well as floor and sealing walls. Thereafter the various plumbing and electrical fixtures are installed. Such a production method is extremely labor-intensive and, therefore, prohibitively expensive under some circumstances.

Thus it has been suggested to make prefabricated buildings, that is buildings formed at least in part at another location. In the simplest type of prefabricated building a plurality of prefabricated wall panels are used, with conventional ceiling and floors being build between them. Such an arrangement has the advantage of extreme flexibility, but the considerable disadvantage that the resulting structure is not a great deal cheaper than a structure produced completely without prefabricated elements, and this structure is frequently not as strong as is required by some building codes.

It has also been suggested to form buildings in completely prefabricated units. Although such an arrangement allows production costs to be cut considerably, as the prefabricated room units can be built on a mass-production basis, the principal difficulty with this type of prefabricated structure is that the choice of room units or structure size is limited to the number of different types of room units available. Thus, a given type of floor plan must be imposed on the buyer, as production of too great a variety in the room units will merely increase production costs up to an undesirable level again.

Another difficulty with most of the known systems is that their assembly is a relatively complex job. Thus, only highly skilled assemblers can make these prefabricated buildings so that, once again, labor costs become a major factor in the price.

SUMMARY OF THE INVENTION

It is therefore an object to provide an improved prefabricated building and method of making same.

Another object is to advance principles set forth in my above-mentioned patent application.

Yet another object is to provide a prefabricated building system and method which allows flexibility in design but which nonetheless can be put up very easily by even a relatively unskilled crew.

Yet another object is the provision of such a prefabricated building which is extremely stable and structurally sound when assembled.

These objects are attained according to the present invention in a multistory building comprising a plurality of first-floor room units resting on a base surface spaced apart and each having a floor panel engaging the base, a ceiling panel parallel to and above the respective floor panel, and a perimetric side wall integral with and extending vertically between the respective floor and ceiling panels. Means is provided for securing each of these units at the respective side wall to the base. A plurality of upright partition panels extend between the room units and subdivide the empty regions therebetween into horizontally separate room spaces. A plurality of horizontally oriented floor panels bridge the room units so as to close off the top of the room spaces. The floor panels are secured to the room units at the side walls thereof and to the partition panels. Thereafter a second floor of room units, partition panels, and floor panels may be provided on top of the first floor formed as described above, the room units of the second floor each being positioned directly on a room unit of the first floor.

Thus it is possible with this system to form room units which normally are constituted as the kitchens and bathrooms. These are the most labor-intensive and expensive rooms in the house so that their mass production greatly decreases building costs. At the same time it is possible for the architect to subdivide the various spaces between these room units into virtually any size or shape room that is desired. Thus, the advantage of completed room units is utilized while at the same time the strictures often entailed by the use of such ready-made room units is avoided.

The building according to this invention can be made with relative ease by a relatively unskilled crew. The original foundation, preferably a concrete slab, need merely be poured with good accuracy and the original room units secured thereto. Afterward, the perfectly plumb and parallel room units can be stacked up and walls and floors interposed between them with considerable ease. The structure will inherently be perfectly straight and square and much of the extremely difficult work, such as running the plumbing lines and the like, is already done so that the finishing of the building is also a relatively chore.

According to features of this invention the slab is formed with concrete and frame elements are embedded in it which have upwardly extending bolts defining an outline corresponding to the outline of a respective room unit. Thus, a plurality of these frame elements is positioned about the site before the slab is poured in the exact position desired, then the slab is poured and, after its curing, the room units are set thereon at the appropriate locations. As the upwardly extending bolts fit into corresponding holes in the bottom of the room units and access apertures allow nuts to be screwed down over these bolts to secure the room units tightly in place. Similar upwardly extending bolts are provided at the tops of the room units and partition walls in order to allow securing of further room units and partition walls on top of these elements. The floor or ceiling panels that are used to bridge between the room units have laterally extending flanges provided with holes through which engage these bolts so as securely to lock these floor or ceiling panels in place.

In the arrangement according to this invention the various panels are all made of reinforced concrete. The room unit is parallepipedal and has parallel ceiling and floor panels with a perimetric side wall formed by a plurality of planar side wall panels extending between the floor and ceiling panel and at right angles to each other. The enormous structural strength of such an integrally cast concrete box forming the room unit therefore makes it possible to build a relatively tall building using these room units as the supporting structural elements.

According to further features of this invention the outermost walls of the buildings, that is the portions of the side walls of the room units and those partition walls which are located on the outer perimeter of the respective floors of the building are provided with a lining or covering of insulating material and, thereover, with a covering of decorative material. Thus, the building can be well insulated and decorated.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 2:
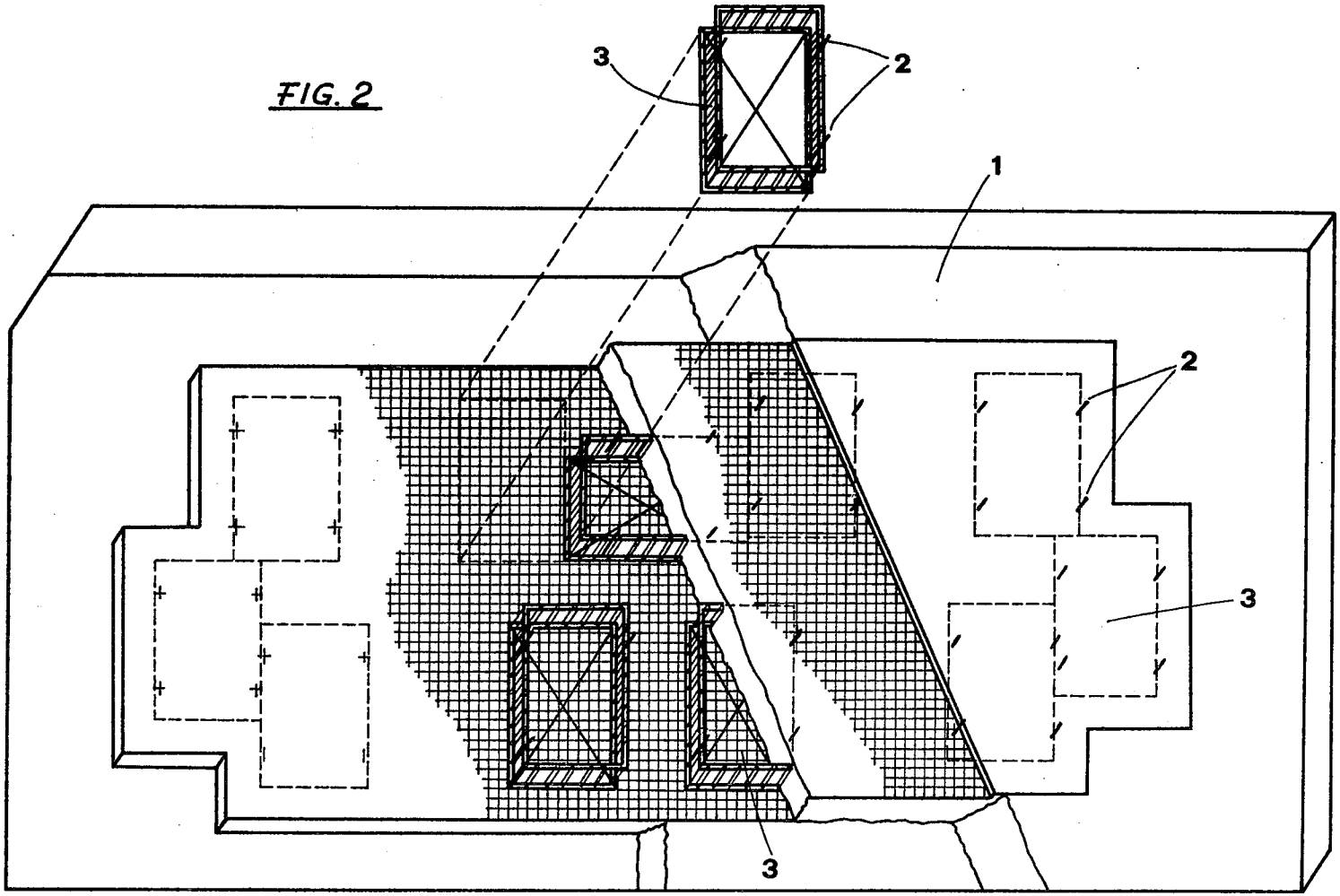
FIG. 2 is a top view partly broken away showing the formation of the base slab for the building of FIG. 1.

As shown in FIG. 2 the building according to the present invention is built up from a base or slab 1 in which is embedded a plurality of frame elements 3 having upwardly extending bolts 2. This slab 1 is formed in three stages. First of all a base smooth slab is put down. The frame elements 3 which are made of reinforcing bars and have the same outline as the room units to be described below are then carefully positioned on this base slab in the exact position the room units are later to assume. Thereafter coarse concrete is poured over these elements 3 to hold them firmly in place and finally a perfectly smooth finish coat is applied so that only the bolts 2 project upwardly from the slab 1. These elements 3 therefore not only serve to position the room units as will be described below, but also, due to their considerable strength as a result of their manufacture out of steel reinforcing bars and their box-girder shape, these elements reinforce the slab 1 at exactly those locations where the most stress will be applied by the building.

Thereafter as shown in FIG. 2 a plurality of room units 5 is secured to the slab 1 over top of the bolts 2. In this arrangement eleven such room units are used, two bathroom units, two kitchen units, four bedroom units, two dining-room units, and a utility shaft unit.

Figure 3:
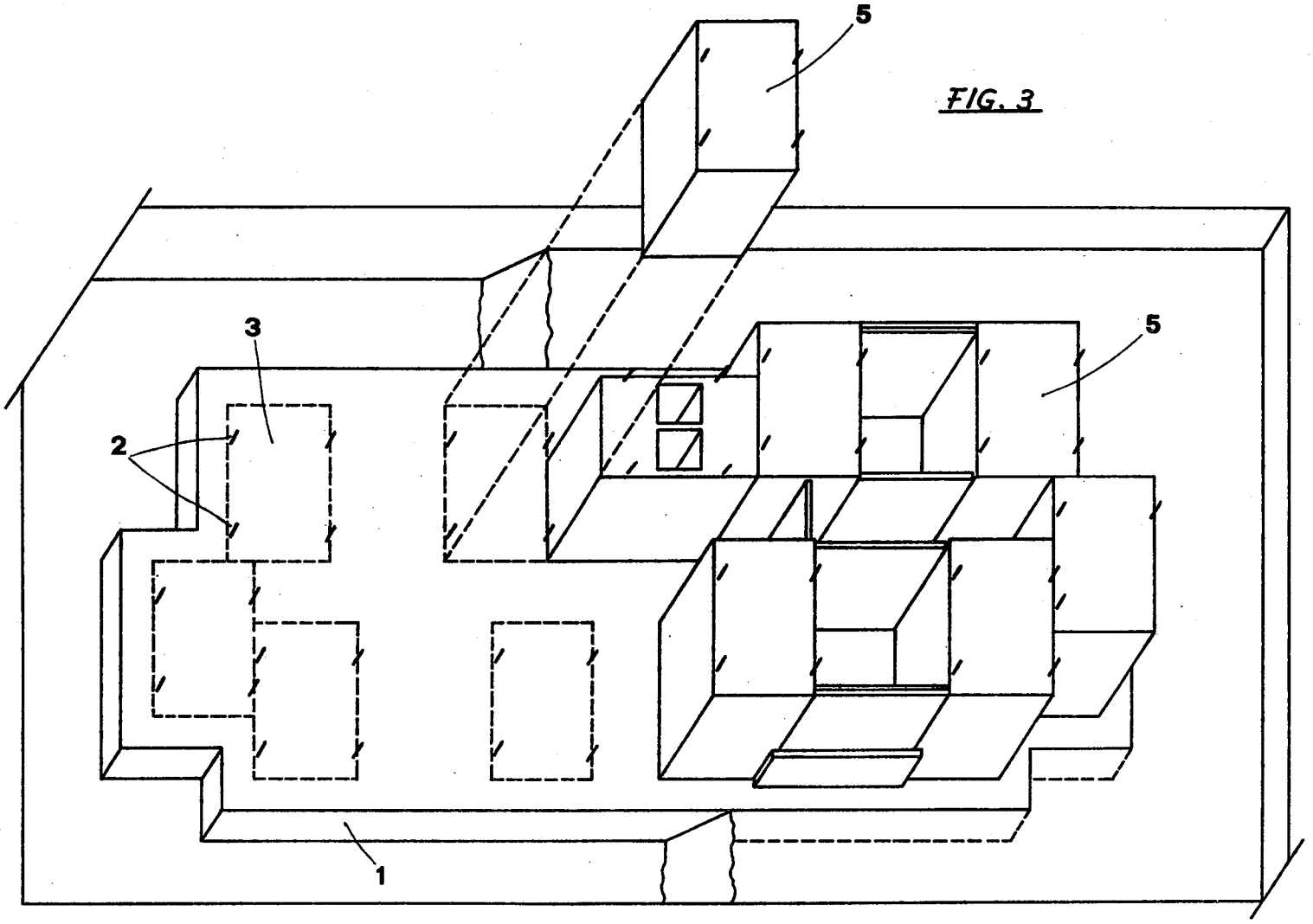
FIGS. 3–5 are similar top views illustrating the building in various progressive stages of construction.
Figure 4:
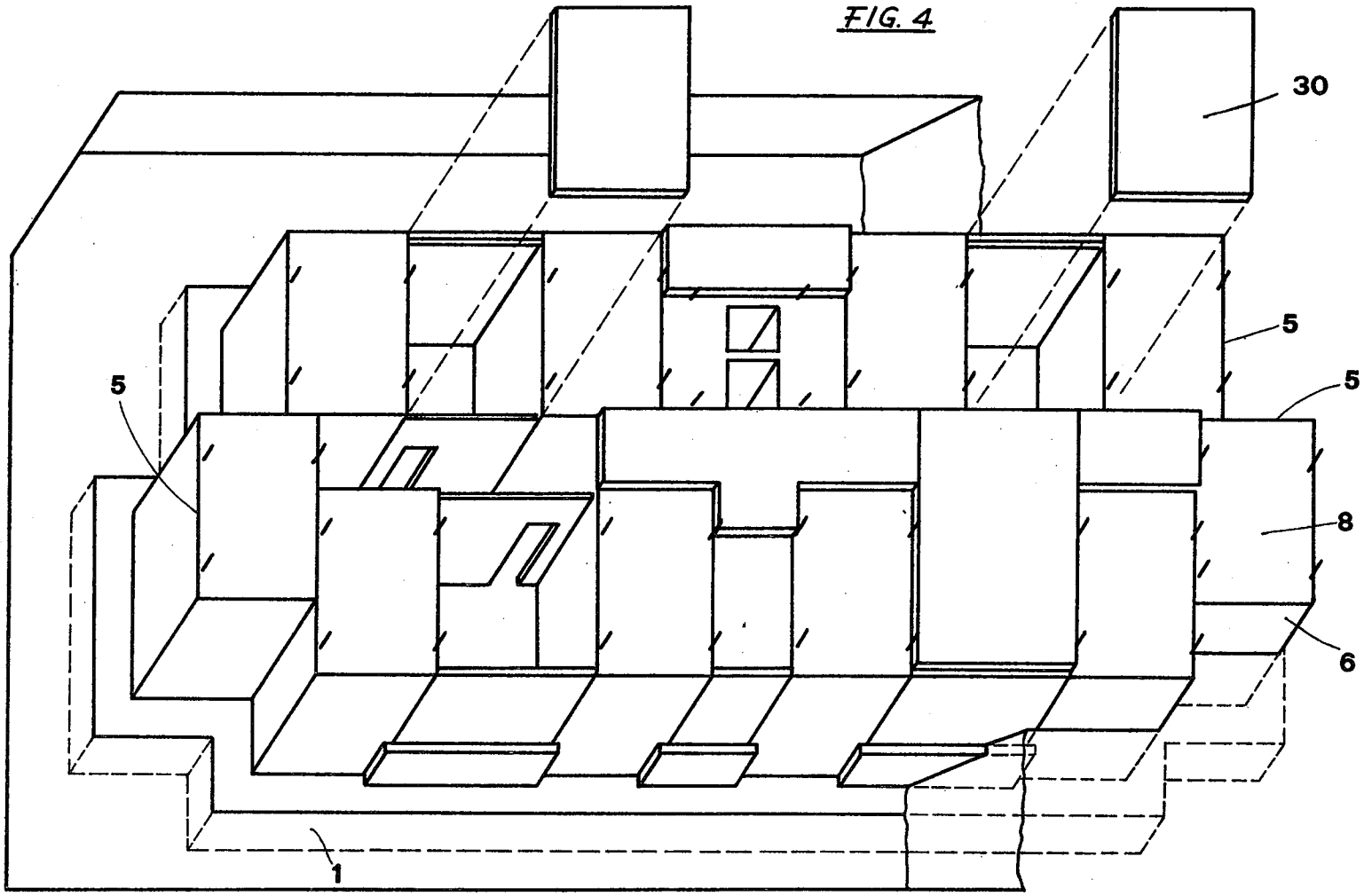
Figure 5:
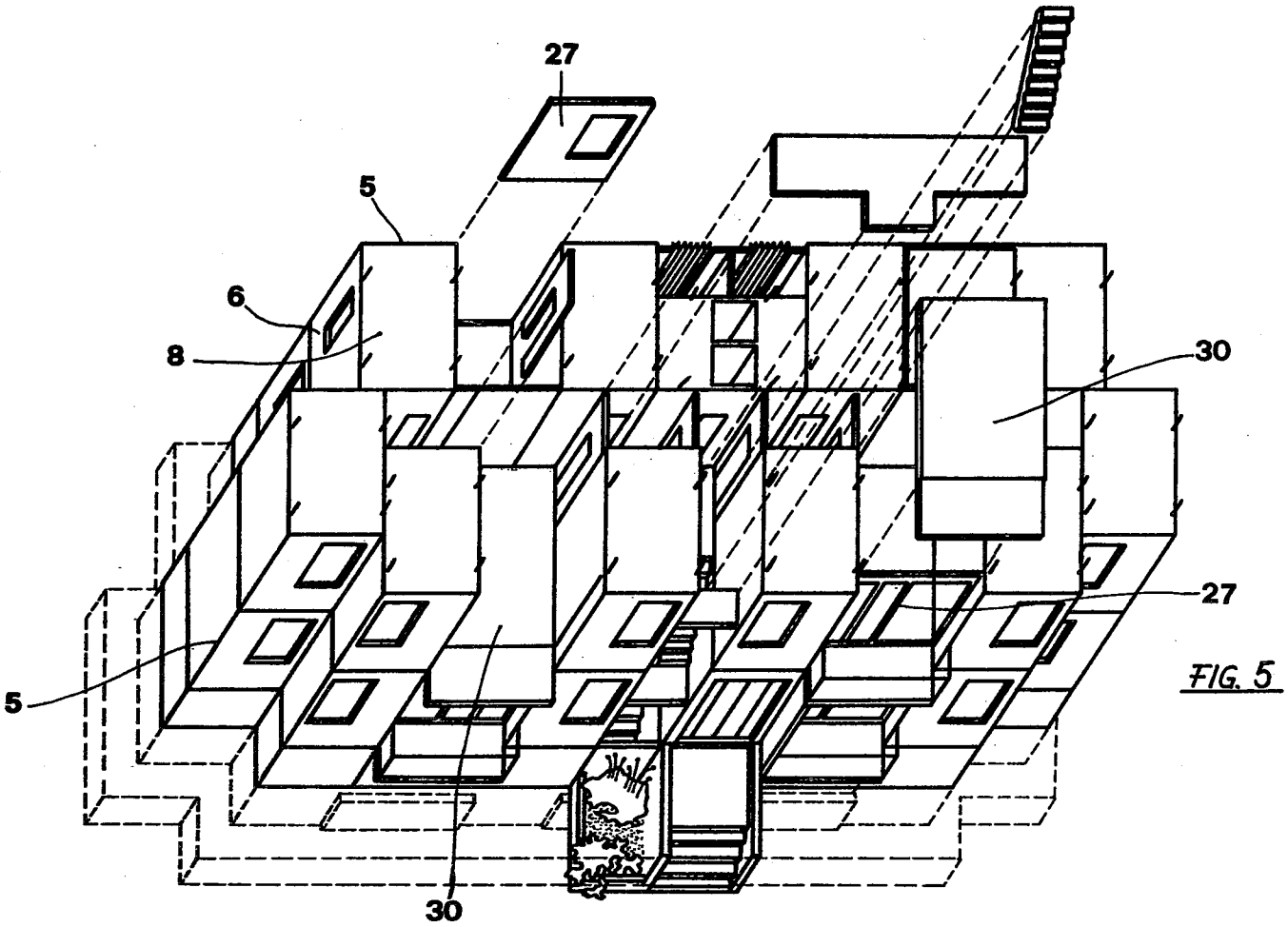
Figure 6:
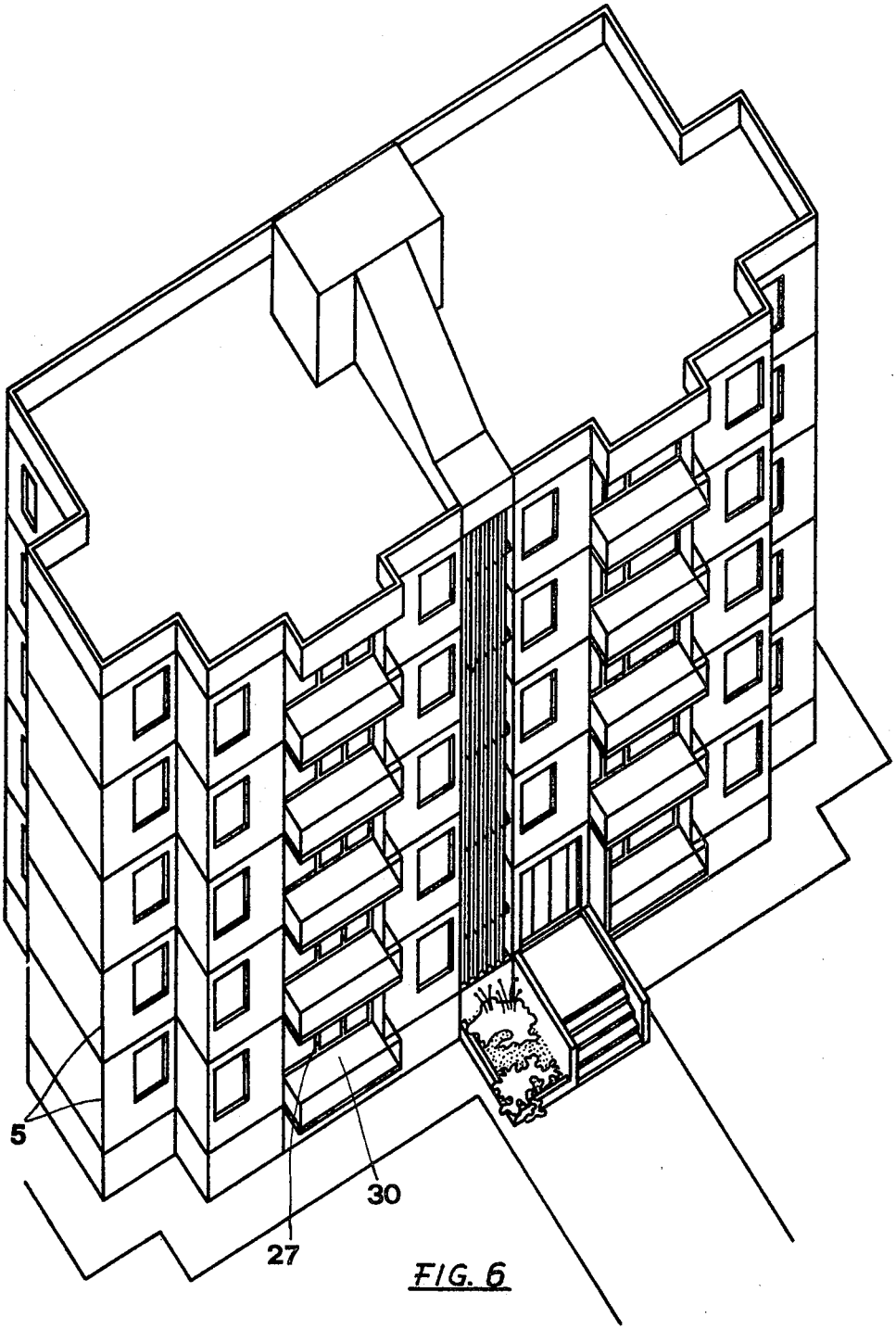
FIG. 6 is a perspective view of the finished building in accordance with this invention.

Thereafter, as shown in FIGS. 3, 4, and 5 partition walls 27 and floor panels 30 are applied between the room units 5 to subdivide the spaces between these room units 5 into room spaces for use as other rooms, hallways, balconies, and the like.

Figure 1:
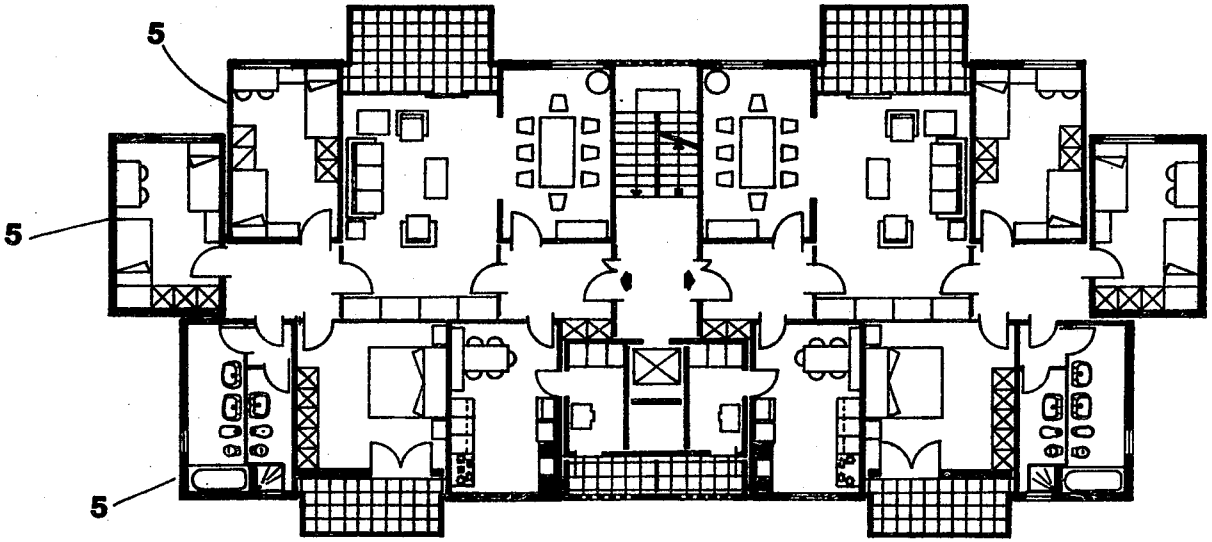
FIG. 1 is a floor plane of a floor of a building according to this invention.

The finished product as shown in FIG. 1 gives two large apartments per floor. Each of these apartments has two bathrooms, three bedrooms, an eat-in kitchen, a dining-room, and a living room, with balconies on the living room and master bedroom. Each such six-room apartment is made up of four prefabricated room units constituting the two bedrooms, kitchen, and dining room, with a fifth room unit forming the two bathrooms. The various service ducts, elevator, and the like are brought up through the central utility duct formed by a stack of room units 5 also.

Each of the room units 5 comprises four side-wall panels 6 extending vertically between a floor panel 7 and a ceiling panel 8. As further shown in FIGS. 7 and 8 the room units 5 are formed as boxes of reinforced concrete with net reinforcement 10 in double layers in the floor 7 and ceiling 8 and similar double-net reinforcement 17 in the wall 6. At the corners box-girders 9 formed of bars 12 and 18 and circumferentially welded rings or clips 13 give the boxes forming the units 5 an extremely large loadbearing capacity. The four iron reinforcing bars 18 shown in FIGS. 7 and 8 extend all around the four sides.

Figure 7:
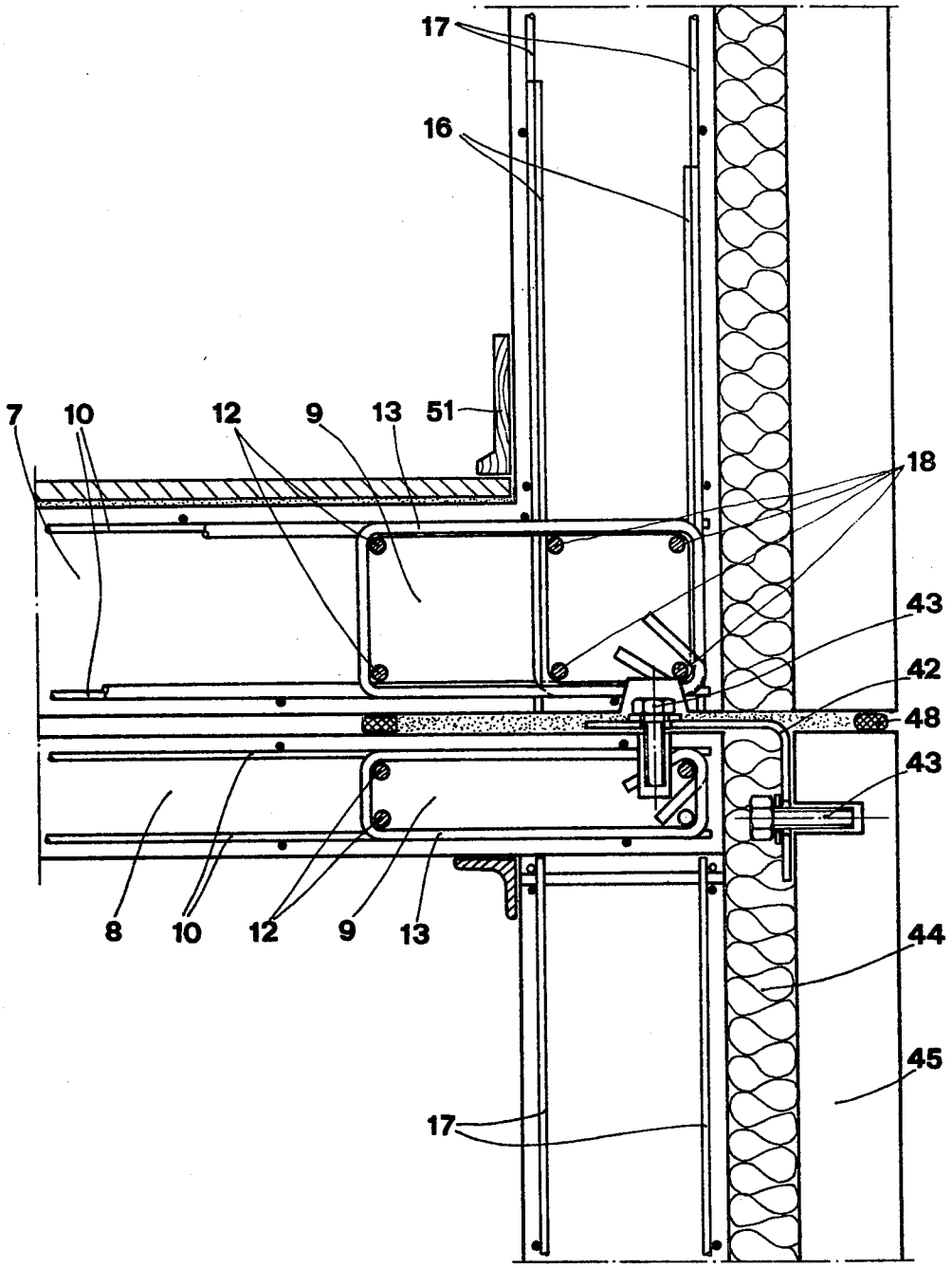
FIG. 7 is a vertical section through the joint between a pair of room units at the outermost wall of the building.
Figure 8:
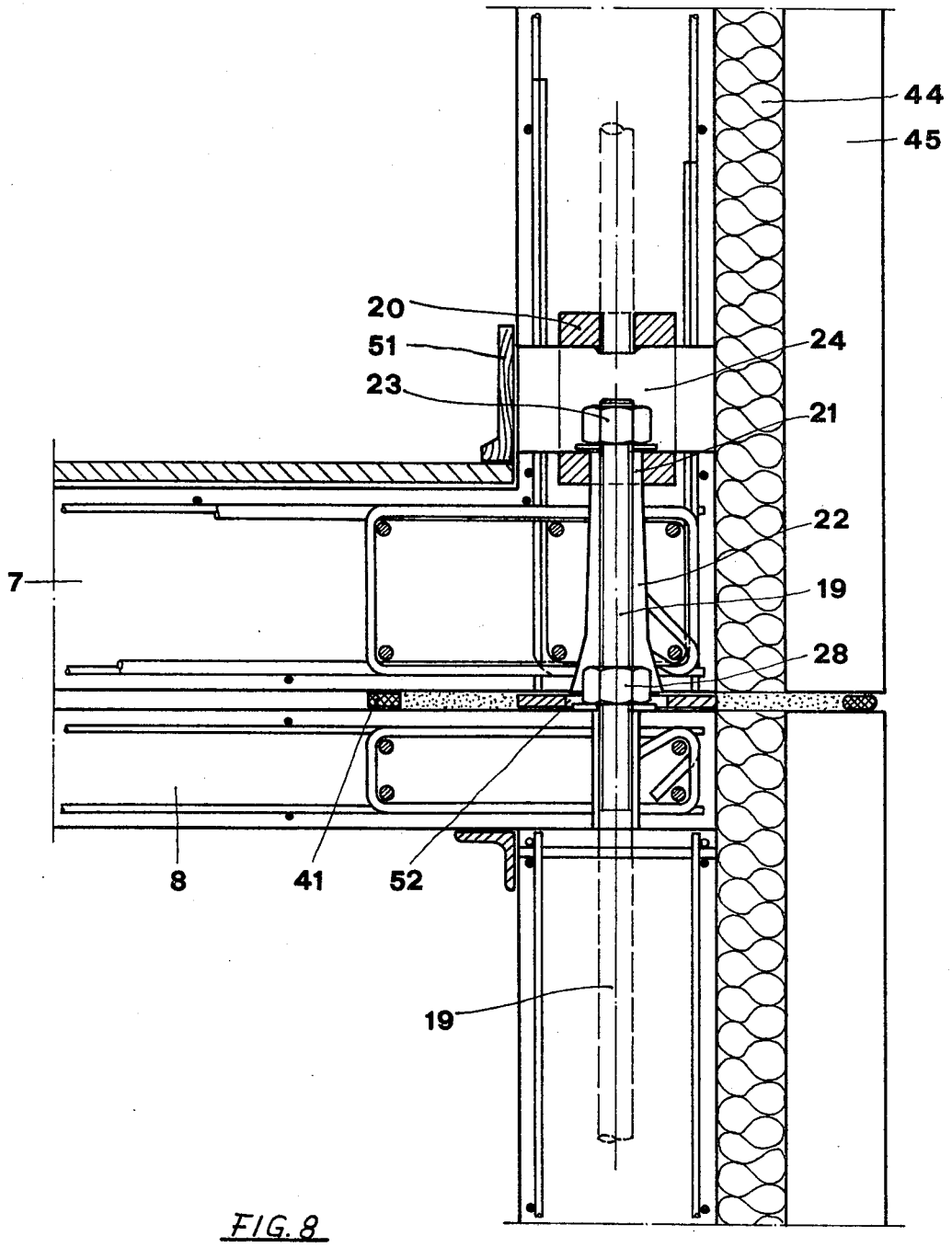
FIG. 8 is a section similar to FIG. 7 showing the interconnection of superposed room units.

As also shown in FIGS. 7 and 8 four threaded iron bars 19 pass vertically through the side walls of each of the room units 5 and project from the top thereof. These bars can be used for hoisting the room units 5 and are positioned in the same manner as the rods 2 shown in FIG. 2. At their lower ends these rods are welded to a ring 20 hidden behind the base board 51 of the corresponding wall panel 6. The upper ends of the bars can pass through holes 21 in the bottom of the ring 20 and 22 formed in the concrete of the wall panel 6 so that a nut 23 can be screwed down over this upper end of the rod 19 and can lock one room unit extremely rigidly on the top of the other, the ring 20 constituting a force-transmitting member between the rods of superposed room units 5. The nut 28 on top of the upper end of the rod 19 and overlying the upper surface of the respective room unit is tightened to prestress the rod 19. After bolting-together of two room units 5 the empty space 24 is filled with mortar and the base board 51 is mounted in place to cover up the hole 24.

Figure 9:
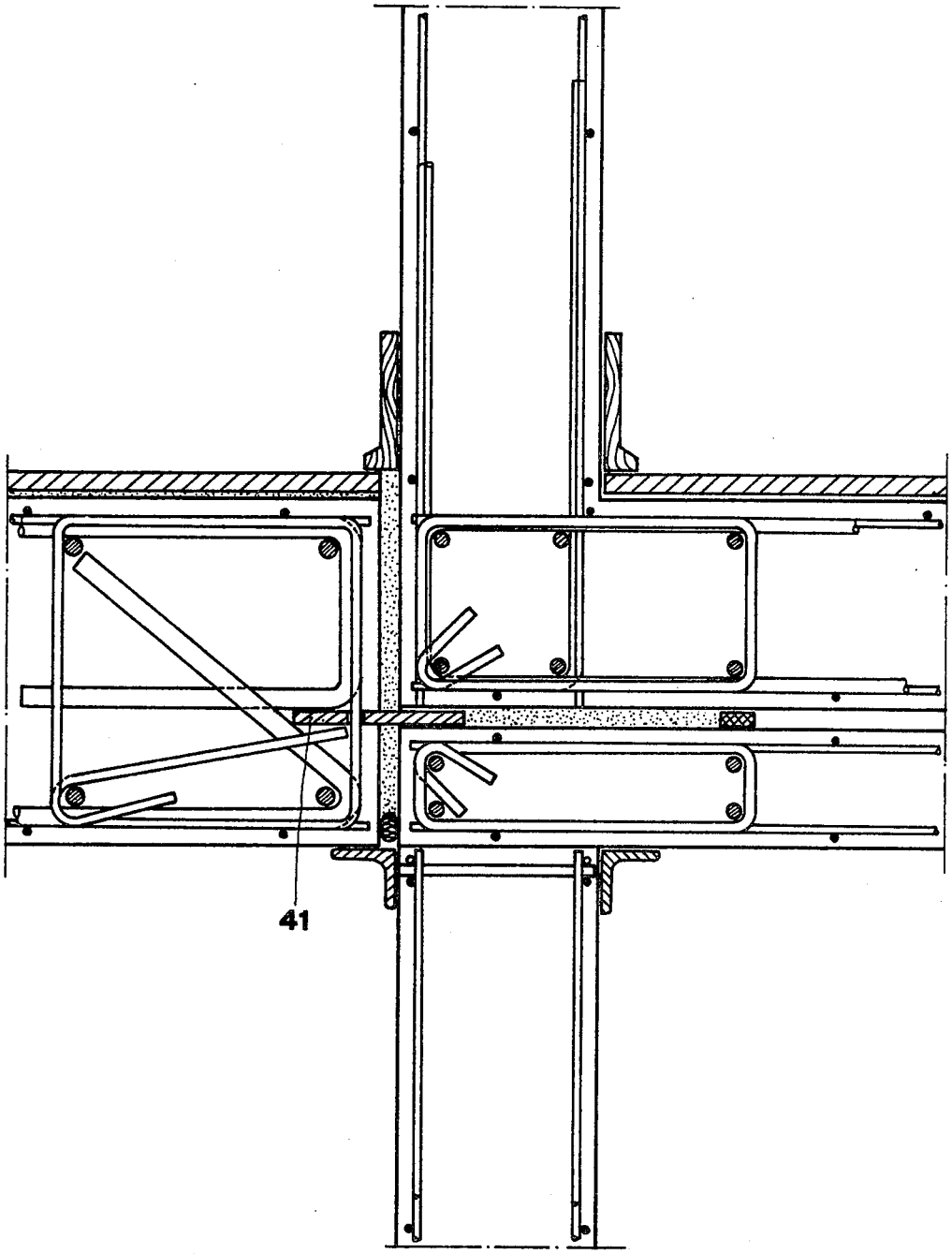
FIG. 9 is a vertical section through a joint between two room units with a floor panel attached thereto.
Figure 10:
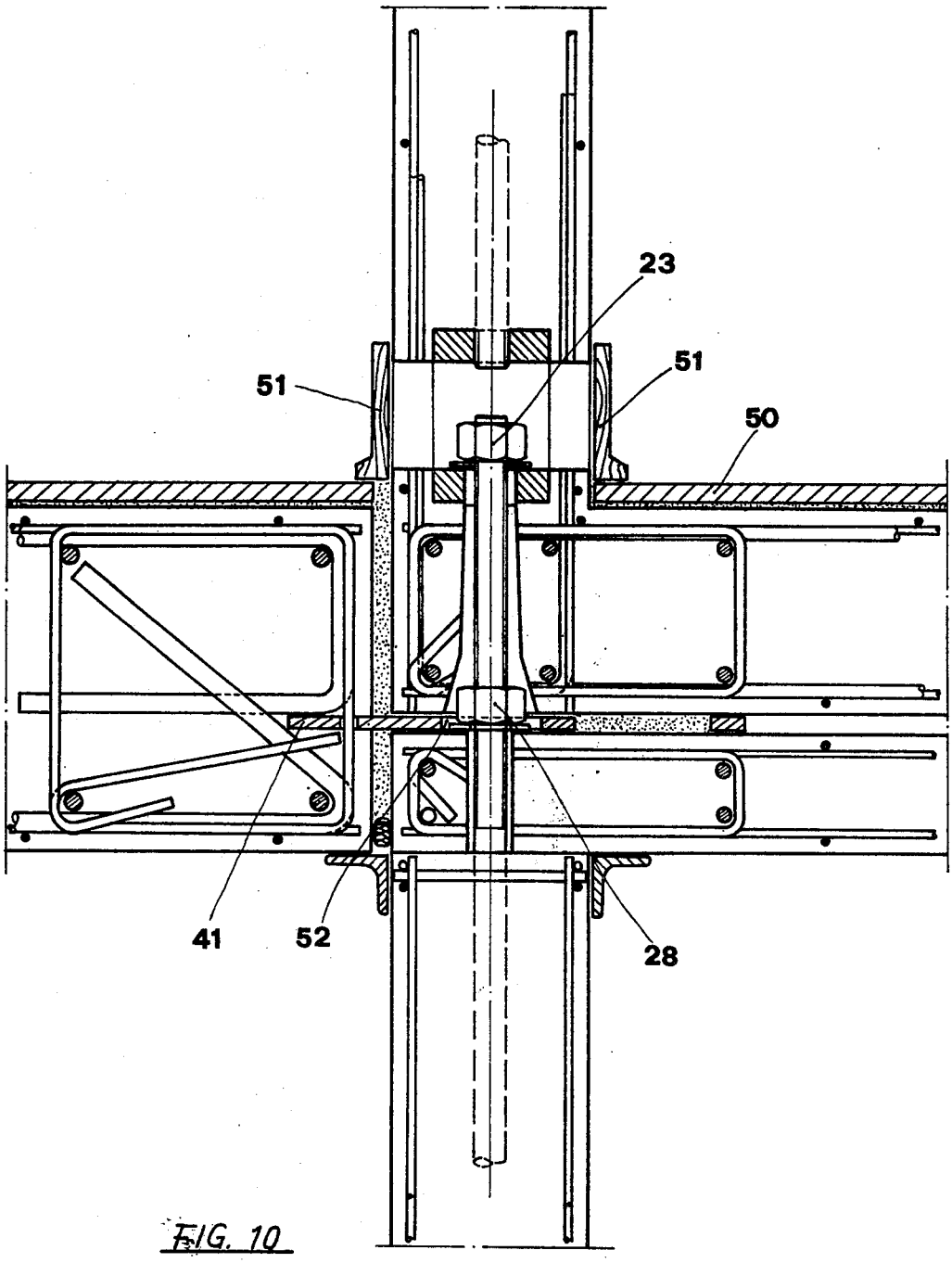
FIG. 10 is a section similar to FIG. 9 showing the bolting-together of the two room units through the floor-panel flange.

As shown in FIGS. 9 and 10 the floor panels 30 are provided with laterally extending flanges 41 receivable between overlying room units 5 so as rigidly to lock the floor member in place. This flange is formed along the full length of the floor panel 30 and has holes 52 through which pass the bolts 19. FIG. 10 also shows how the floor panels as well as the floors 7 are provided with finished flooring material 50.

Figure 11:
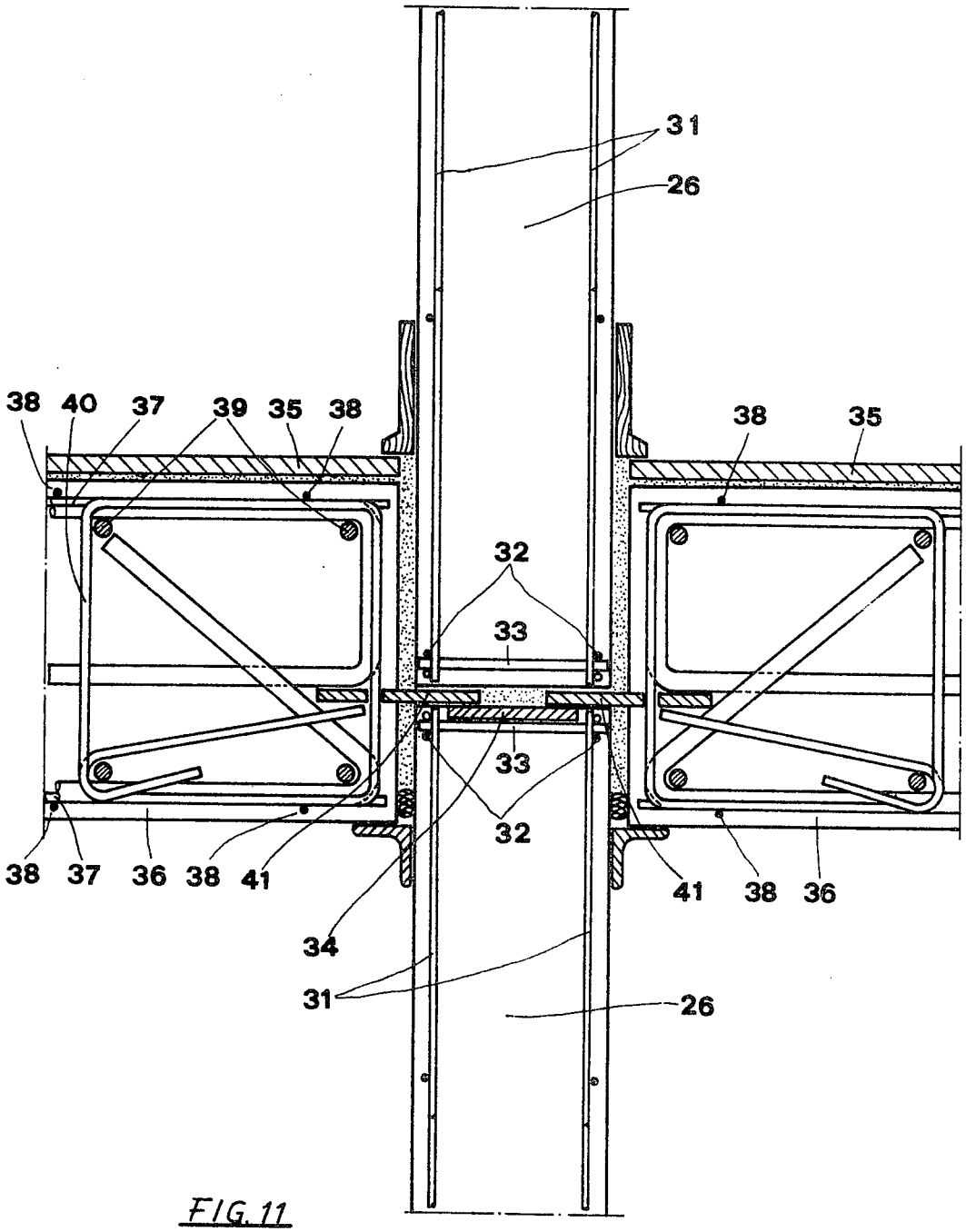
FIG. 11 is a vertical section through the joint between a pair of superposed partition walls and a pair of floor panels connected thereto.
Figure 12:
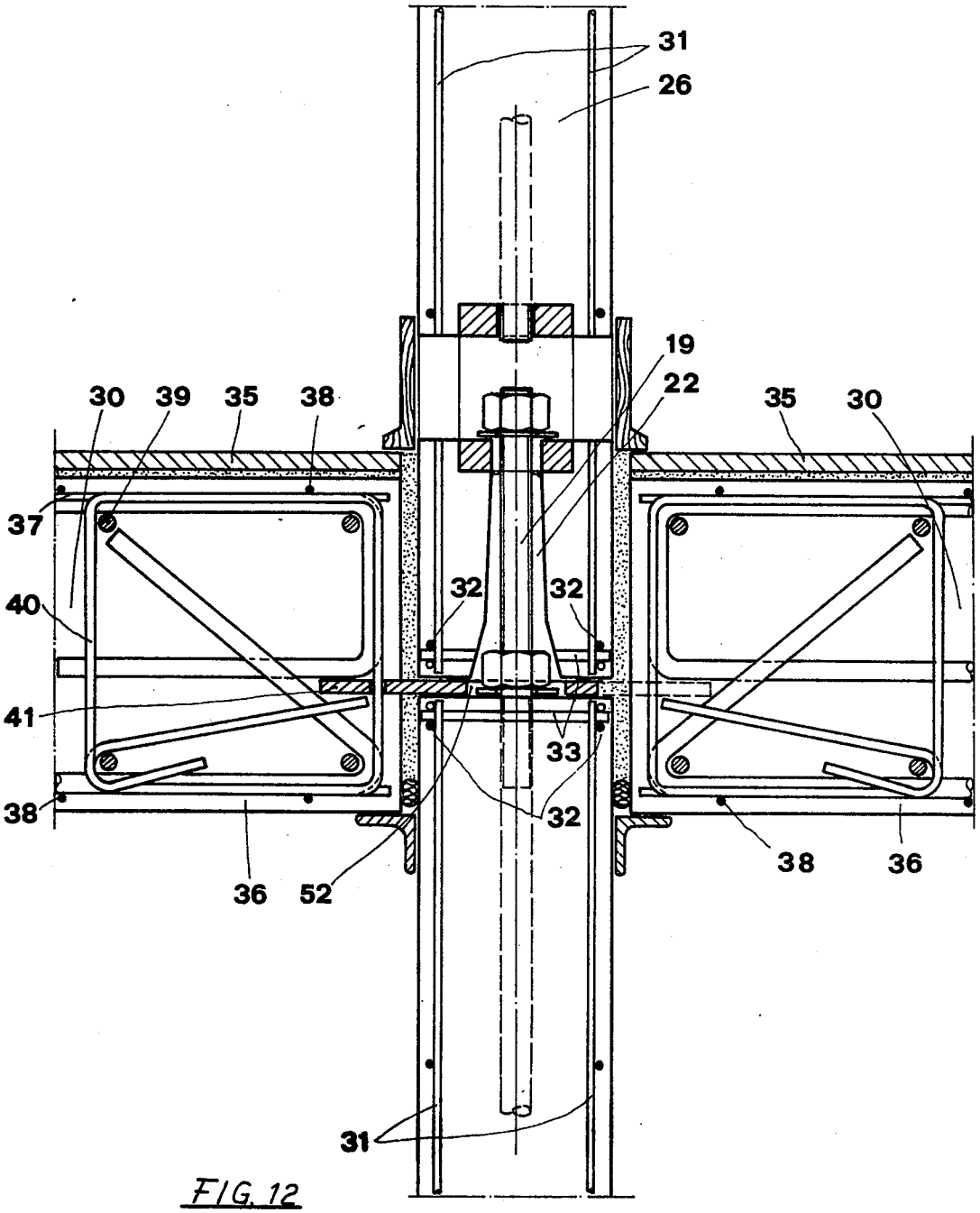
FIG. 12 is a section similar to FIG. 11 showing the bolt joint between the two partition panels.

FIGS. 10 and 11 show a pair of superposed partition panels 26 similar to the panels 27 and provided with double-net reinforcing 31. These panels 26 serve as partitions and also as load-bearing panels and are provided with vertically through-going bolts 19 identical to the bolts in the room units 5 and are similarly provided with sleeves 20 and holes 22 for vertical interconnection of the partition walls 26 as described below for the room units 5. At their lower edges the walls 26 have horizontally extending reinforcement rods 32 and 33. The upper edges of each of the partition walls has a metal plate 34 through which the bolts 19 project and against which the nuts 28 may bear.

Each of the so-called floor panels 30, which actually also constitute the ceiling panel as each floor panel 30 carries on its upper surface flooring material 35 and on its lower surface ceiling material 36, is formed with reinforcement net 37 and at the corner with box girders 38 formed by horizontal rods 39 held together by clips 40. These elements 38 and 40 are electrically welded together, and the slabs constituting the panels 30 are hollow so as to minimize weight and are formed with stiffening ribs throughout.

Figure 13:
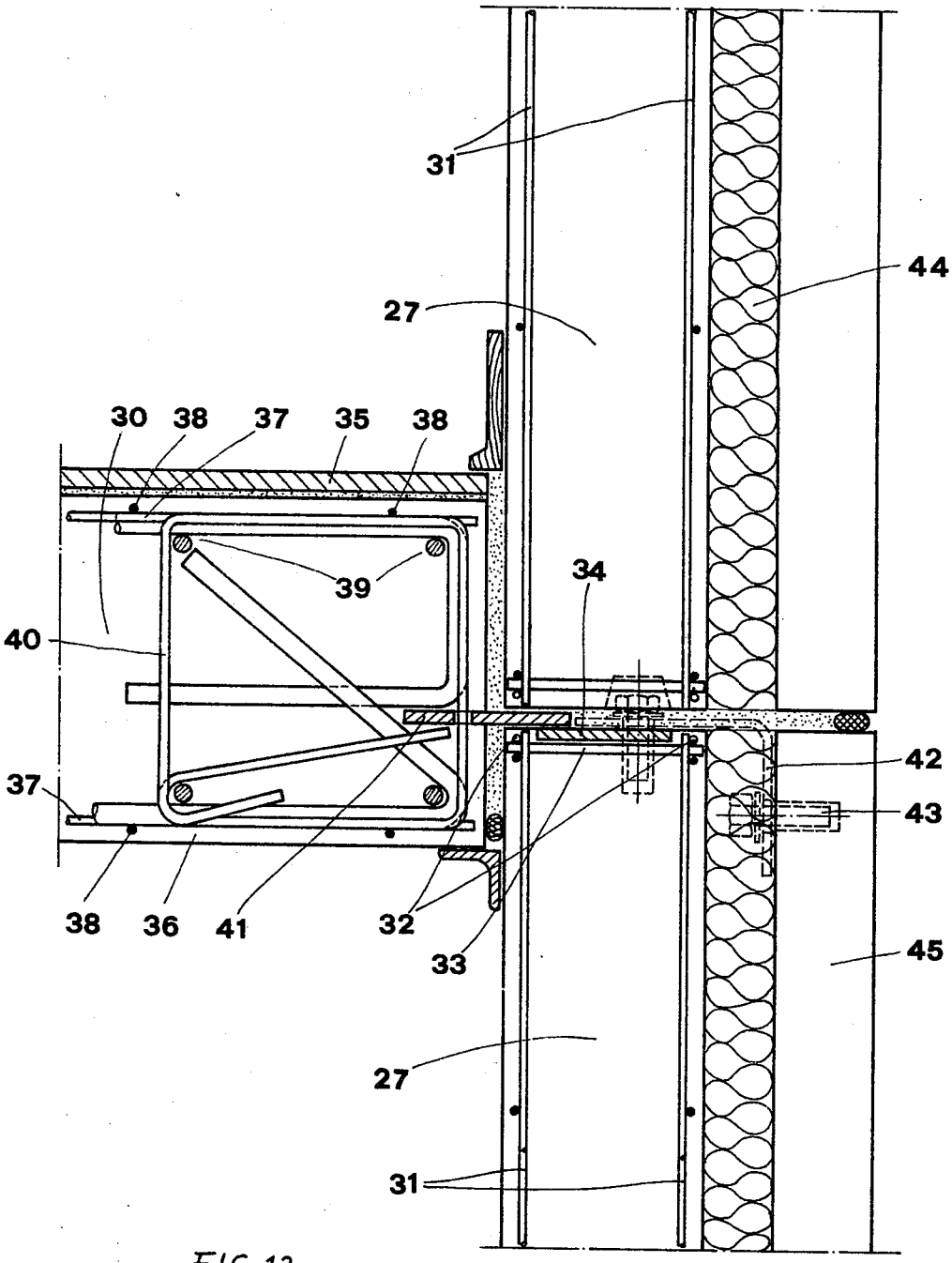
FIG. 13 is a vertical section showing the joint between a pair of partition panels at the outermost wall of the building and a floor panel attached thereto.
Figure 14:
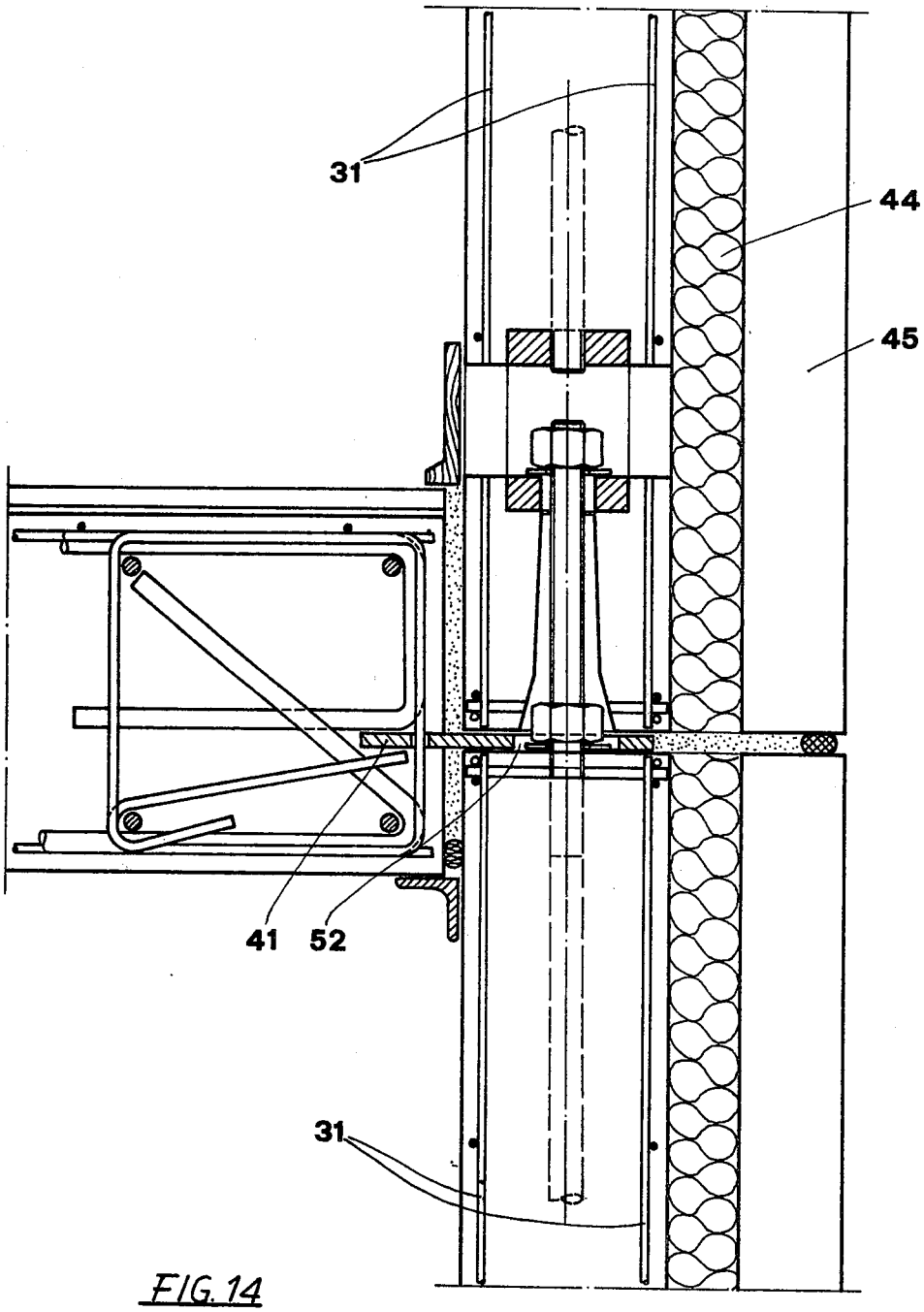
FIG. 14 is a section similar to FIG. 13 showing the bolt joint between the two partition panels and the floor panels.
Figure 15:
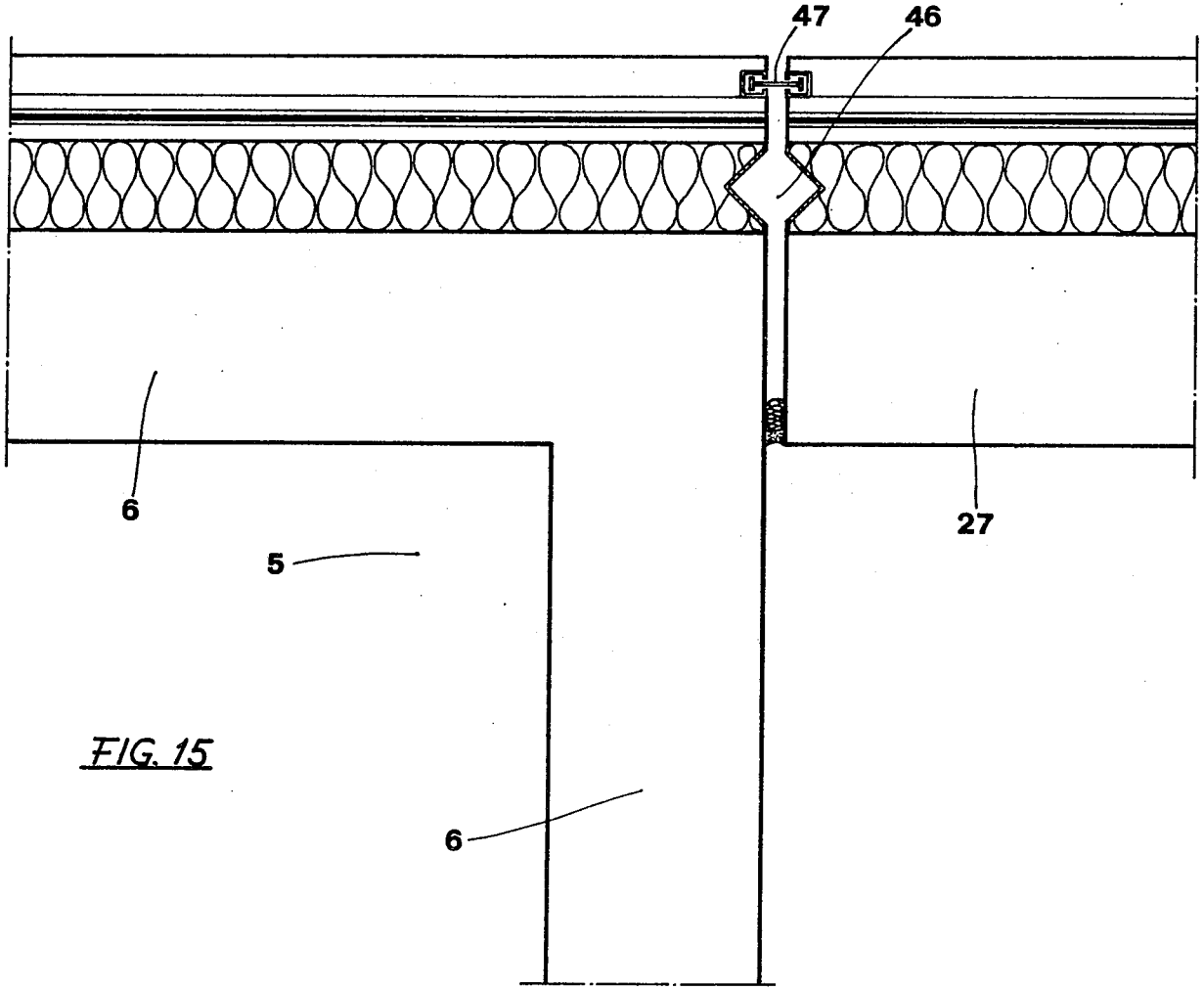
FIG. 15 is a horizontal section through the joint between a room unit and a partition panel.

As also shown in FIGS. 13 and 14 a layer 44 of insulating material and decorative covering 45 may be applied to the outer partition panels serving as facade panels 27. Angle-irons 42 and screws 43 as best shown in FIG. 7 secure these layers 44 and 45 tightly to the front of the building. In addition seals 48 are provided between overlying elements. Vertically extending seals 47 shown in FIG. 15 are provided between adjoining elements so as to form voids 46 to prevent condensation.

With the system according to the present invention it is therefore possible for the manufacturer to build a limited number of basic room units and to provide various sized wall panels between them. The architect can then decide on design with considerable flexibility while using these standard items. The room units 5 are extremely structurally sound so that it is possible to build a very stable building with them.

It will be understood that each of the elements described above, or two or more together, may also find a useful application in other types of structures differing from the types described above.

While the invention has been illustrated and described as embodied in a prefabricated building assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of making a multistory building, said method comprising the steps of:

(a) providing a base;

(b) positioning in spaced-apart relationship on said base a plurality of box-like room units each having a parallel ceiling and floor joined by a continuous perimetric side wall;

(c) securing said room units to said base at said side walls thereof;

(d) positioning partition panels in upright position between said room units to subdivide the regions between said room units into horizontally separated room spaces defined by said room units and said partition panels;

(e) bridging floor panels between said room units over at least some of the upwardly open room spaces;

(f) positioning horizontally projecting flanges on said floor panels so that bolts extending upwardly from said side walls project vertically through said flanges;

(g) positioning on top of each of said room units a second-floor room unit;

(h) securing said second-floor room units to the underlying room units at said side walls by attaching nuts over the upper ends of the bolts extending upwardly through the flanges to the lower ends of similar bolts in the second-floor room units; and (i) repeating steps (d), (e), and (f) sequentially with partition and floor panels on said second-floor room units.

2. The method defined in claim 1 wherein said base is formed by casting with concrete.

3. The method defined in claim 3, further comprising the step of imbedding in said concrete a plurality of annular frame elements each having the same outline as a respective side wall and provided with upwardly extending connectors, said room units of step (b) being positioned over a respective frame element and each being secured to the connectors thereof.

4. The method defined in claim 1, further comprising the step of providing insulation on the outermost side walls and partition walls.

5. A multistory building comprising:

a fixed base defining a horizontal base surface and provided with a plurality of horizontally spaced polygonal arrays of studs projecting upwardly from said surface;

a box-like first-floor reinforced-concrete room unit resting on said base surface at each of said arrays and each having a polygonal floor engaging said base, a polygonal ceiling parallel to and above the respective floor, and a perimetric side wall coinciding with the respective array and integral with and extending vertically between the respective floor and ceiling;

a plurality of upright rods in each of said side walls each having an upper end extending upwardly beyond the respective ceiling and a lower end slightly above the respective floor;

means including a nut engaged between each of said lower ends and a respective one of said studs for securing each of said room units at its side wall to said base;

a plurality of upright reinforced-concrete partition panels of the same height as said side walls extending between said room units and subdividing the empty regions between said room units into horizontally separate room spaces;

a plurality of horizontal reinforced-concrete floor panels bridging said room units above said room spaces;

means including laterally projecting flanges on said floor panels formed with vertically throughgoing holes through which extend the respective upper ends of the respective rods for securing said floor panels to said room units at said side walls thereof and to said partition panels;

a second floor such reinforced-concrete room unit on top of each of said first-floor room units;

a plurality of upright rods in each of the side walls of said second-floor units and each having an upper end extending upwardly beyond the respective ceiling and a lower end slightly above the respective floor;

means including a plurality of nuts each engaged between a respective upper end of a rod of a first-floor unit and a respective lower end of a rod of a second-floor unit for securing each of said second-floor units at its side wall to the respective underlying first-floor unit;

a plurality of upright second-floor reinforced-concrete partition panels of the same height as said side walls extending between said second-floor room units and subdividing the empty regions therebetween into horizontally separate second-floor room spaces;

a plurality of horizontal reinforced-concrete roof panels bridging said second-floor room units above said second-floor room spaces; and means including laterally projecting flanges on said roof panels formed with vertically throughgoing holes through which extend the upper ends of the respective rods for securing said roof panels to said second-floor room units at said side walls thereof and to said second-floor partition panels.

6. The building defined in claim 5 wherein each of said room units is formed with downwardly open holes at its side wall at the respective lower ends of the respective rods, said nuts being engageable with said rods in said holes.

7. The building defined in claim 5 wherein each of said room units is parallelepipedal.

8. The building defined in claim 7 wherein said base includes a mass of concrete and imbedded therein a plurality of frames each having the same outline as a respective first-floor room unit and each having a plurality of upwardly projecting bolts constituting said studs.

9. The building defined in claim 5 wherein said side walls are formed by a plurality of joined and hollow side panels.

10. The building defined in claim 5 wherein each of said partition panels has an upper edge provided with a metal plate anchored to the reinforcement of the respective partition panel.

11. The building defined in claim 5, further comprising a layer of insulating material on the outermost side walls and partition panels and a layer of facing material over each layer of insulating material.

12. The building defined in claim 5, wherein each of said upper ends is threaded and each of said lower ends is provided with a horizontally open ring formed with a vertically open aperture, each of said side walls being formed with a recess at each of said rings and each of said upper ends being engageable through a respective recess and aperture in a respective ring.

13. The building defined in claim 5, wherein each of said partitions is provided with a plurality of such upright rods.

14. The building defined in claim 5, wherein said flanges are sandwiched between said room units.

15. The building defined in claim 5, wherein said floors and ceilings are rectangular.

* * * * *